US009793657B2

(12) United States Patent
Du et al.

(10) Patent No.: US 9,793,657 B2
(45) Date of Patent: Oct. 17, 2017

(54) ELECTRICAL CONNECTOR WITH A METALLICAL SUPPORTING MEMBER SECURED THERETO

(71) Applicant: FOXCONN INTERCONNECT TECHNOLOGY LIMITED, Grand Cayman (KY)

(72) Inventors: Juan Du, Kunshan (CN); Chun-Ming Yu, Kunshan (CN); Guo-Hua Zhang, Kunshan (CN); Liang Gong, Kunshan (CN)

(73) Assignee: FOXCONN INTERNCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/456,586

(22) Filed: Mar. 13, 2017

(65) Prior Publication Data

US 2017/0264034 A1 Sep. 14, 2017

(30) Foreign Application Priority Data

Mar. 12, 2016 (CN) ..... 2016 2 0187309 U
Mar. 18, 2016 (CN) ..... 2016 2 0209449 U

(51) Int. Cl.
*H01R 13/6594* (2011.01)
*H01R 12/70* (2011.01)
*H01R 12/71* (2011.01)

(52) U.S. Cl.
CPC ..... *H01R 13/6594* (2013.01); *H01R 12/7082* (2013.01); *H01R 12/716* (2013.01)

(58) Field of Classification Search
CPC ..... H01R 13/6594
See application file for complete search history.

(56) References Cited

U.S. PATENT DOCUMENTS 8,262,414 B1 9/2012 Li et al.
2014/0315405 A1* 10/2014 Yu ..... H01R 13/7032 439/188

(Continued)

FOREIGN PATENT DOCUMENTS

CN 204315842 U 11/2012
CN 203967344 U 11/2014
CN 204230555 U 3/2015

*Primary Examiner* — James Harvey
(74) *Attorney, Agent, or Firm* — Wei Te Chung; Ming Chieh Chang

(57) ABSTRACT

A high-profile electrical connector includes a terminal module, a metallic shell and a metallic supporting member. The terminal module has an insulative housing and a plurality of conductive terminals. The insulative housing has a base portion provided with a mounting face and an insulative mating portion. The conductive terminals have contacting portions and connecting legs. The metallic shell shielding around the terminal module has a metallic mating portion surrounding around the insulative mating portion and a plurality of printed circuit board mounting legs. The metallic mating portion has a lower face which is higher than the mounting face. The metallic supporting member has a supporting plate used for supporting the lower face and at least a supporting leg extending downwardly. The supporting plate is higher than the mounting face so that the supporting plate is spaced from an upper surface of the printed circuit board.

19 Claims, 7 Drawing Sheets

(56) References Cited

U.S. PATENT DOCUMENTS

| | | | | |
|---|---|---|---|---|
| 2016/0104976 | A1* | 4/2016 | Yu | H01R 13/6585<br>439/607.05 |
| 2017/0117646 | A1* | 4/2017 | Park | H01R 12/7076 |

* cited by examiner

ELECTRICAL CONNECTOR WITH A METALLICAL SUPPORTING MEMBER SECURED THERETO

BACKGROUND OF THE INVENTION

1. Field of the Invention

The present invention generally relates to an electrical connector, particularly to an electrical connector provided with a supporting member secured thereto.

2. Description of Related Art

Chinese patent issued NO. CN204315842 discloses a high-profile electrical connector. The electrical connector has a terminal module and a metallic shell shielding around the terminal module. The terminal module has an insulative housing and a plurality of conductive terminals received in the insulative housing. The insulative housing has a base portion and a mating tongue extending forwardly therefrom. The base portion has a mounting surface. The metallic shell has an inner shell surrounding the mating tongue and an outer shell retained around the inner shell. The inner shell has a mating portion surrounding the mating tongue and an opening facing forwardly. The mating portion has a lower surface higher than the mounting face. The inner shell has two first mounting legs disposed at two opposite sides of the base portion. The outer shell has two second mounting legs disposed at two opposite sides of the mating portion. The mating portion is spaced from a printed circuit board when it is mounted to the printed circuit board. Therefore the electrical connector is not easy to be destroyed due to shaking of the mating portion.

Therefore, an electrical connector provided with a supporting member is desired hereinafter.

SUMMARY OF THE INVENTION

Accordingly, an object of the present invention is to provide a high-profile electrical connector.

In order to achieve the object set forth, a high-profile electrical connector is mounted upon a printed circuit board. The electrical connector comprises a terminal module, a metallic shell shielding around the terminal module and a metallic supporting member. The terminal module has an insulative housing and a plurality of conductive terminals received in the insulative housing. The insulative housing has a base portion provided with a mounting face and an insulative mating portion extending forwardly from the base portion. The conductive terminals have contacting portions exposed to the insulative mating portion and connecting legs extending out of the mounting face. The metallic shell shielding around the terminal module has a metallic mating portion surrounding around the insulative mating portion and a plurality of printed circuit board mounting legs. The metallic mating portion has a lower face which is higher than the mounting face. The metallic supporting member is used for supporting the lower face. The supporting member has a supporting plate used for supporting the lower face and at least a supporting leg extending downwardly. The supporting plate is higher than the mounting face so that the supporting plate is spaced from an upper surface of the printed circuit board.

Other objects, advantages and novel features of the invention will become more apparent from the following detailed description when taken in conjunction with the accompanying drawings.

DETAILED DESCRIPTION OF THE INVENTION

Figure 1:
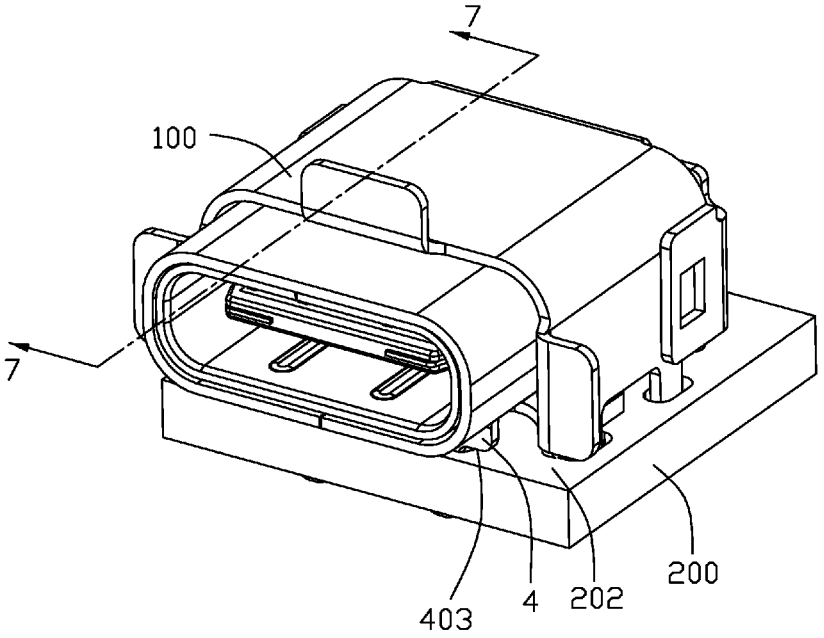
FIG. 1 is a perspective view of an electrical connector of the present invention, wherein the electrical connector is mounted onto a printed circuit board.

Reference will now be made in detail to the preferred embodiment of the present invention.

Referring to FIGS. 1-7, the present invention is provided with a high-profile electrical connector 100. The electrical connector 100 is mounted onto a printed circuit board 200. The electrical connector 100 has a terminal module 20, a metallic shell 3 shielding around the terminal module 20 and a supporting member 4. Combined with FIG. 5 and FIG. 6, the terminal module 20 has an insulative housing 1 and a plurality of conductive terminals 2 received therein. In some embodiments, the conductive terminals 2 are retained to the insulative housing 1 by an insert molding process. In some embodiments, the conductive terminals 2 are retained to the insulative housing 1 by an assembling process. The insulative housing 1 has a base portion 11 and an insulative mating portion extending forwardly from the base portion 11. In the present embodiment, the insulative mating portion is configured as a mating tongue 12. In some other embodiments, the insulative housing 1 is recessed from a front face thereof to form the insulative mating portion. The specific structure is determined by a specific demand. The base portion 11 has a mounting face 111 and a front face 112. The mating tongue 12 extends forwardly from the base portion 11 and is located above the front face 112. In the present preferred embodiment, the mounting face 111 and the front face 112 are perpendicular from each other. In some other embodiments, shapes of the front face 112 may be disposed as difference. The conductive terminals 2 have contacting portions 21 exposed to the mating tongue 112 and connecting legs 22 extending out of the mounting face 111. In the present embodiment, the conductive terminals 2 have a row of first terminals and a row of second terminals disposed at two opposite sides of the mating tongue 12, and a metallic shielding plate 5 disposed between the row of the first terminals and the row of the second terminals. The metallic shielding plate 5 has two opposite side latches 50 diposed at two sides of the mating tongue 12 to latch with a latching structure of a complementary connector.

Figure 2:
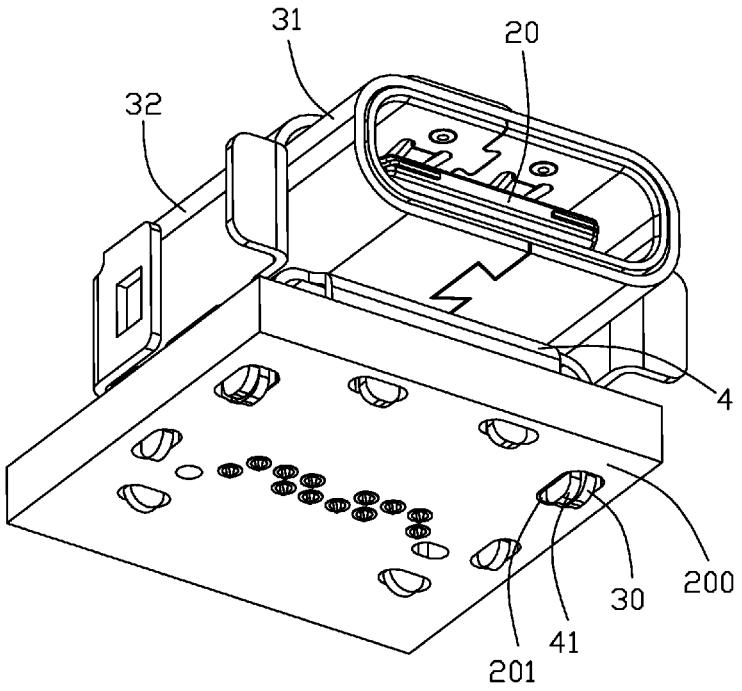
FIG. 2 is another perspective view of the electrical connector shown in FIG. 1.
Figure 3:
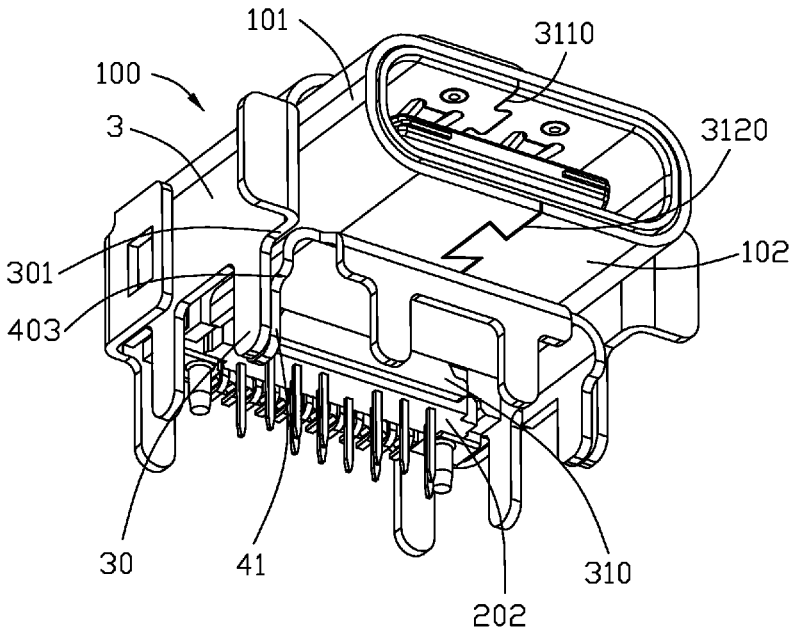
FIG. 3 is a perspective view of the electrical connector shown in FIG. 1.
Figure 4:
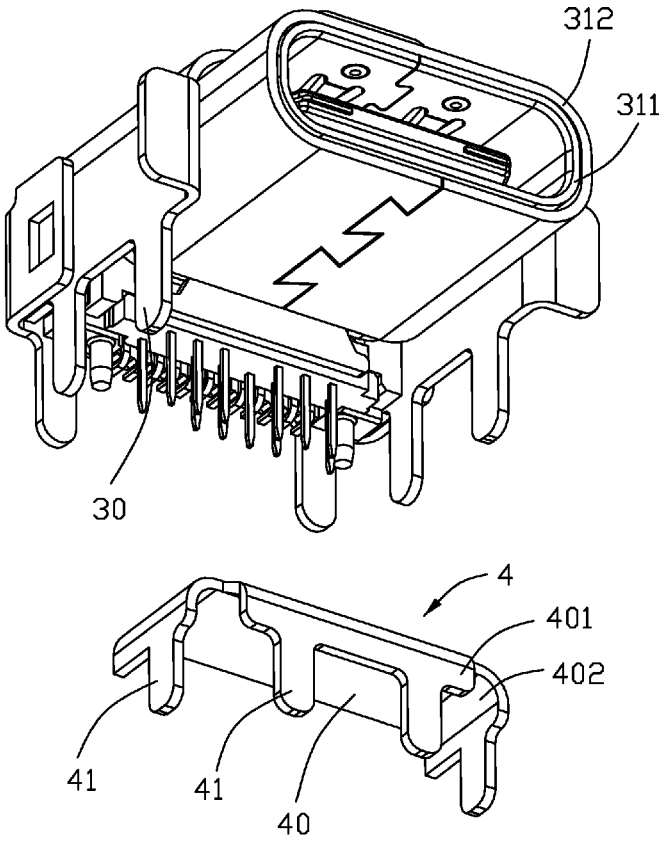
FIG. 4 is a part exploded perspective view of the electrical connector shown in FIG. 1, wherein the supporting portion is separated from the main body.
Figure 5:
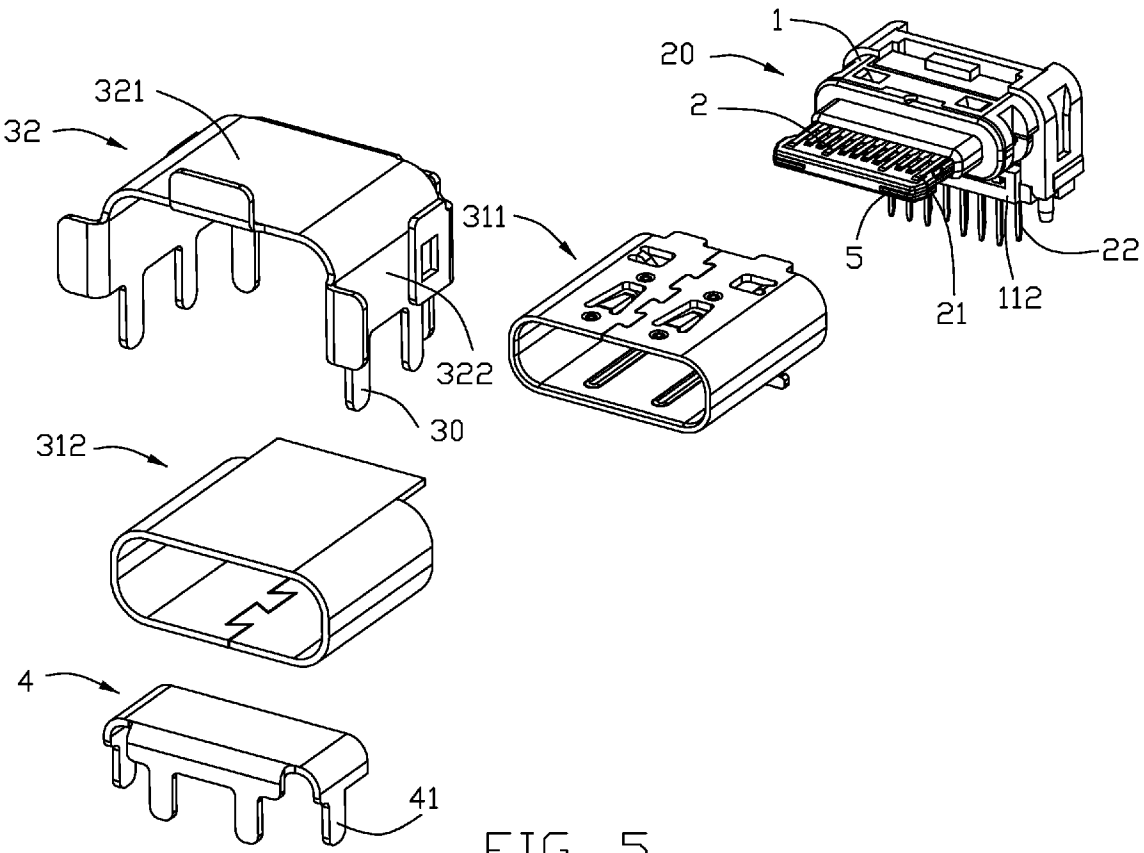
FIG. 5 is a part exploded perspective view of the electrical connector shown in FIG. 3.
Figure 6:
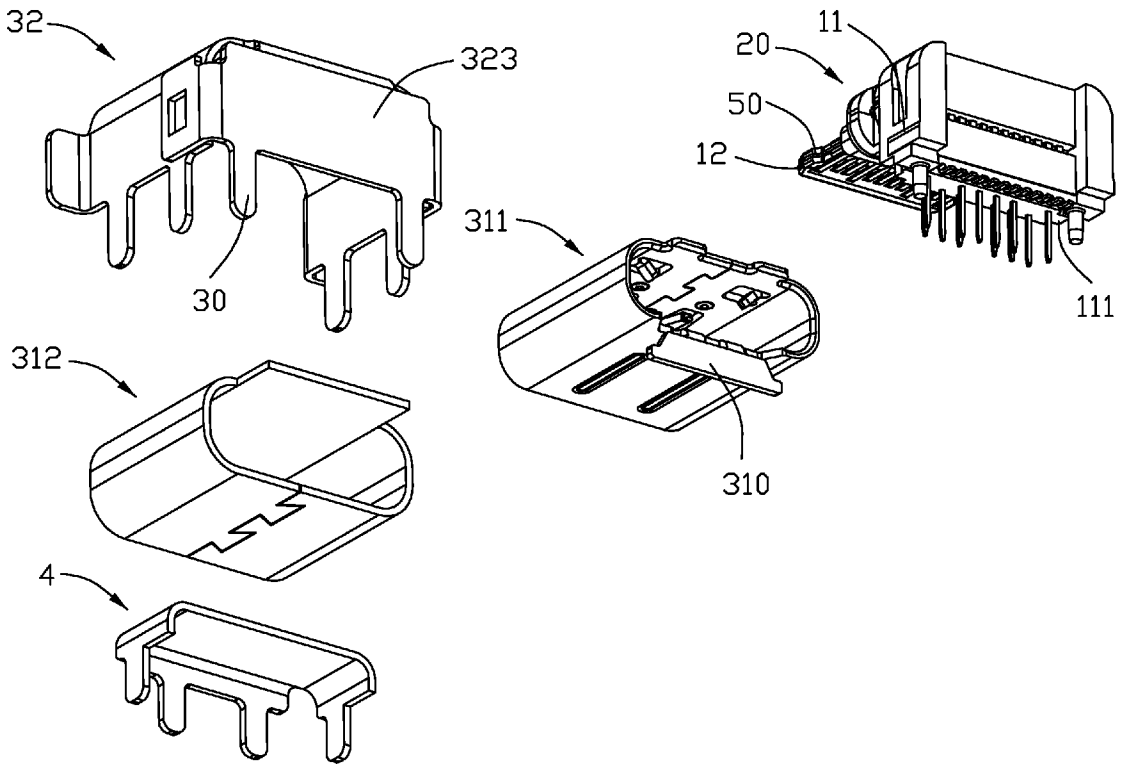
FIG. 6 is another perspective view of the electrical connector shown in FIG. 5.
Figure 7:
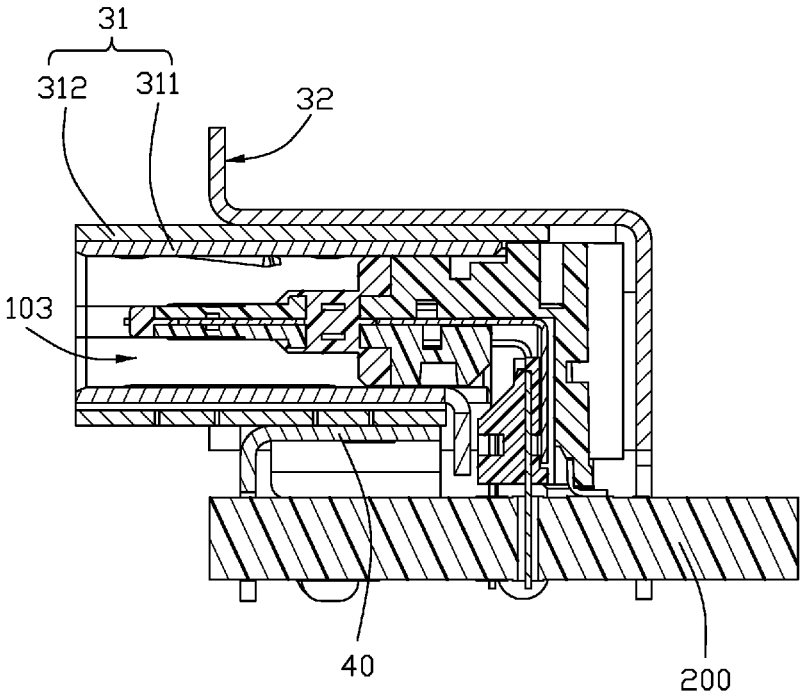
FIG. 7 is a cross-sectional view of the electrical connector shown in FIG. 1.

Referring to FIG. 2, FIG. 3 and FIG. 5, the metallic shell 3 has a metallic mating portion 101 surrounding the insulative mating portion and at least a printed circuit board mounting leg 30 extending downwardly. In the present preferred embodiment, the metallic mating portion 101 forms a mating cavity 103 (FIG. 7) to surround the mating tongue 12 with an opening facing forwardly to communicate with an exterior for allowing the corresponding plug connector to be inserted into the mating cavity. The metallic mating portion 101 has a lower face 102 higher than the mounting face 111. That is to say, the electrical connector 100 is high-profile. In the present preferred invention, the mounting face 111 is parallel to the lower face 102. The front face 112 is located below the metallic mating portion 101. The metallic shell 3 has a shielding portion 310 shielding around the front face 112.

The metallic shell 3 has an inner shell 31 surrounding the mating tongue 12 and an outer shell 32 retained to the inner shell 31. The inner shell 31 has not any printed circuit board mounting leg. The outer shell 32 defines the printed circuit board mounting leg 30. In a front-to-back direction, a front edge of the outer shell 32 is located behind a front edge of the inner shell 31 so as to make connecting seam of the inner shell 31 to be exposed outside. The inner shell 31 has a first inner shell 311 and a second inner shell 312 surrounding around an outer side of the first inner shell 311. The first inner shell 311 has a first connecting seam 3110, and the second inner shell 312 has a second connecting seam 3120. The first connecting seam 3110 and the second connecting seam 3120 are respectively disposed at two opposite sides along a vertical direction perpendicular to the front-to-back direction, thereby the electrical connector 100 is not easy to be tore from the first connecting seam 3110 and the second connecting seam 3120 when the electrical connector 100 mates with the complementary connector. Combined with FIG. 4 and FIG. 5, the outer shell 32 has a main body 321 retained on an upper surface of the inner shell 31, two side wing portions 322 located at two sides of the inner shell 31 and a rear cover 323 shielding around a rear end of the base portion 11. The side wing portions 322 defines the printed circuit board mounting legs 30, and the rear cover 323 defines the printed circuit board mounting legs 30. The side wing portion 322 has lower side edge 301 from which the printed circuit board 30 extending downwardly.

Referring to FIG. 1 to FIG. 4, in the present preferred embodiment, the mounting face 111 seats on the printed circuit board 200 after the electrical connector 100 is mounted onto the printed circuit board 200. The metallic mating portion 101 is disposed above and spaced from the printed circuit board 200 along the vertical direction.

The supporting member 4 is stamped by a piece of metal plate and disposed to the lower face 102. The supporting member 4 is assembled to the lower face 102 along a down-to-up direction after the inner shell 31 and the outer shell 32 are assembled to the terminal module 20. In the present preferred embodiment, the supporting member 4 is retained to the metallic shell 3 by a laser welding technology, thereby operation process is easy, and stationary is strong. The supporting member 4 has a supporting plate 40 supporting to the lower face 102 and a plurality of supporting legs 41 extending downwardly. When the electrical connector 100 is mounted onto the printed circuit board 200, the supporting plate 40 is higher than the mounting face 111, thereby the supporting member 4 stands on the printed circuit board 200 with a space therebetween. The supporting legs 41 are fixed to the printed circuit board 200. In the present preferred embodiment, the supporting legs 4 are soldered to the printed circuit board 200. In some other embodiments, the supporting legs 4 may be inserted into the printed circuit board 200. The supporting legs 41 of the supporting member 4 are fixed to the printed circuit board 200 to facilitate the installation stability of the electrical connector 100, and improve electrical connector's swing strength and extend the service life of the electrical connector 100. The supporting member 4 has a plurality of extending portions 401 bending downwardly from side edges thereof. The extending portions 401 have lower edges 403 from which the supporting legs 41 extending downwardly. The supporting leg 41 is narrower than the extending portion 401. The lower side edges 403 of the extending portions 401 are lower than the lower side edges 301 of the side wing portions 322 to seat on the upper surface 202 of the printed circuit board 200. The length of the supporting leg 41 is shortened to be not easily damaged during use, thereby the strength of the supporting member 4 is enhanced. The extending portions 401 seat upon the upper surface 202 of the printed circuit board 200 to facilitate the installation stability of the electrical connector 100 and further increase the swing strength. In the present preferred embodiment, the supporting legs 41 are disposed in front of the base portion 11. Wherein, some of the supporting legs 41 are disposed adjacent to the corresponding printed circuit board mounting legs 30. The printed circuit board mounting leg 30 and the adjacent supporting leg 41 may be mounted in a same mounting hole 201 of the printed circuit board 200, thereby the installation stability of the electrical connector 100 can be further enhanced. In more preferred embodiment, the adjacent circuit board mounting leg 30 and the supporting leg 41 are just attached with each other. Some of the supporting legs 41 are disposed at a front end of the supporting plate 40 and extend downwardly. In the present preferred embodiment, the supporting member 4 has extending portions 401 and supporting legs 41 disposed at the two sides thereof, and the supporting member 4 also has extending portions 401 and supporting legs 41 disposed at the front side thereof. The extending portion 401 disposed at the lateral side of the supporting member 4 and the extending portion 401 disposed at the front side of the supporting member 4 are together to form a gap 402 therebetween. Of course, in some other embodiments, the supporting member 4 may only define the supporting legs 41 which adjacent to the corresponding printed circuit board mounting legs 30, and the supporting member 4 also may only define the supporting legs 41 extending downwardly from the front edge of the supporting plate 40. Besides, the printed circuit board mounting legs 30 disposed at the side wing portions 322 extend downwardly from two sides of the metallic mating portion 101. The supporting legs 41 are disposed at an inner side relative to the printed circuit board mounting legs 30. In this embodiment, the front edge of the supporting member 4 is rearwardly spaced/offset, in said front-to-back direction, from the front edge of the shell 3 with a distance not less than one half of a dimension the mating cavity along the front-to-back direction. Notably, even though in this embodiment the supporting member 4 and the shell 3 are discrete from each other, in an alternate embodiment the supporting member 4 may be unitarily formed with the second inner shell 312, if desired. In this embodiment, the front edge of the printed circuit board is essentially located between the front edge of the supporting member 4 and the outermost front edge the inner shell 31 of the shell 3, In fact, the outermost front edge of the shell 3 is formed by on a front edge of the inner shell 31 while the front edge of the supporting member 4 is located slightly behind the front edge of the outer shell 32 along the front-to-back direction.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

We claim:

1. A high-profile electrical connector used to be mounted upon a printed circuit board, comprising:

a terminal module having an insulative housing and a plurality of conductive terminals received therein, the insulative housing having a base portion with a mounting face and an insulative mating portion extending forwardly from the base portion, the conductive terminals have contacting portions exposed to the insualtive mating portion and connecting legs extending out of the base portion;

a metallic shell shielding around the terminal module, the metallic shell having a metallic mating portion surrounding around the insulative mating portion and a plurality of printed circuit board mounting legs, the metallic mating portion having a lower face which being higher than the mounting face; and a metallic supporting member having a supporting plate supporting the lower face and at least a supporting leg extending downwardly, and the supporting plate being higher than the mounting face for having the supporting plate spaced from an upper surface of the printed circuit board.

2. The electrical connector as claimed in claim 1, wherein the supporting plate directly supporting the lower face.

3. The electrical connector as claimed in claim 1, wherein the supporting leg of the supporting member is fixed to the printed circuit board.

4. The electrical connector as claimed in claim 3, wherein the supporting leg is fixed to the printed circuit board by a welding technology.

5. The electrical connector as claimed in claim 1, wherein the supporting member is stamped from a piece of metal plate, the supporting member has at least an extending portion bending downwardly from a side edge thereof, and the supporting leg extends downwardly from the extending portion and is narrower than the extending portion.

6. The electrical connector as claimed in claim 5, wherein the electrical connector is entirely disposed above the printed circuit board, the metallic shell has an inner shell and an outer shell retained thereto, the outer shell has two side wing portions disposed at two sides of the inner shell, the side wing portion has a lower side edge from which the printed circuit board mounting leg extending downwardly, the extending portion has a lower side edge from which the supporting leg extending downwardly, and the lower side edge of the extending portion is lower than the lower side edge of the side wing portion so that the extending portion supports on the upper surface of the printed circuit board.

7. The electrical connector as claimed in claim 1, wherein the supporting leg is disposed adjacent to the corresponding printed circuit board mounting leg, and the adjacent supporting leg and printed circuit board mounting leg are fixed to a common mounting hole of the printed circuit board.

8. The electrical connector as claimed in claim 1, wherein the mounting face and the lower face are parallel with each other, two said printed circuit board mounting legs extend downward from two sides of the metallic mating portion, and the supporting leg is disposed in front of the base portion and located at an inner side relative to the printed circuit board mounting legs.

9. The electrical connector as claimed in claim 1, wherein the insulative mating portion is configured as a mating tongue, the metallic shell has an inner shell surrounding the mating tongue and an outer shell retained to the inner shell, the inner shell has a first inner shell and a second inner shell surrounding around the first inner shell, the first inner shell has a first connecting seam, the second inner shell has a second connecting seam, and the first connecting seam and the second connecting seam are respectively disposed at two opposite sides along a vertical direction.

10. A high-profile electrical connector being mounted onto a printed circuit board, comprising:

a terminal module having an insulative housing and a plurality of conductive terminals received therein, the insulative housing having a base portion provided with a mounting face and an insulative mating portion extending forwardly from the base portion, the conductive terminals having contacting portions exposed to the insulative mating portion and connecting legs extending out of the base portion;

a metallic shell shielding around the terminal module, the metallic shell has a metallic mating portion surrounding around the insulative mating portion and a plurality of printed circuit board mounting legs, the metallic mating portion having a lower face higher than the mounting face; and a supporting member having a supporting plate supporting the lower face and at least a supporting leg extending downwardly for being fixed to the printed circuit board, and the supporting plate being higher than the mounting face for having the supporting plate spaced from an upper surface of the printed circuit board.

11. The electrical connector as claimed in claim 10, wherein said supporting member is of one piece and made of metal.

12. The electrical connector as claimed in claim 11, wherein the supporting member has an extending portion bending downwardly from which the supporting leg extends downwardly, and the supporting leg is narrower than the extending portion.

13. An electrical connector assembly comprising:

a printed circuit board defining an upper surface on which an electrical connector is mounted, said electrical connector including:

a terminal module having an insulative housing and a plurality of conductive terminals received therein, the insulative housing having a base portion with a mounting face facing downwardly toward the upper surface of the printed circuit board in a vertical direction, and an insulative mating portion extending forwardly from the base portion along a front-to-back direction perpendicular to said vertical direction, the conductive terminals have contacting portions exposed to the insualtive mating portion and connecting legs extending out of the base portion and mounting to the printed circuit board;

a metallic shell shielding around the terminal module, the metallic shell having a metallic mating portion surrounding around the insulative mating portion and a plurality of printed circuit board mounting legs mounting to the printed circuit board, the metallic mating portion forming a mating cavity, in which the insulative mating portion is received for snugly receiving a mating plug connector, and having a lower face located below said mating cavity and facing downwardly toward the upper surface of the printed circuit board in said vertical direction; and a metallic supporting member having a supporting plate upwardly abutting against the lower face in the vertical direction, and at least a supporting leg extending downwardly mounting upon the printed circuit board so as to have the supporting plate resist a downward force applied upon the supporting member during mating;

said shell includes an inner shell and an outer shell, the printed circuit board mounting legs unitarily extend from the outer shell, and a front edge of the inner shell is located in front of a front edge of the outer shell.

14. The electrical connector assembly as claimed in claim 13, wherein the lower face is directly downwardly exposed to the upper surface of the printed circuit board.

15. The electrical connector assembly as claimed in claim 14, wherein the supporting member is welded to the shell for securing therebetween.

16. The electrical connector assembly as claimed in 13, wherein a front edge of the supporting member is rearwardly offset in the front-to-back direction from an outermost front edge of the shell with a distance which is not less than one half of a dimension of the mating cavity along the front-to-back direction.

17. The electrical connector assembly as claimed in claim 13, wherein said shell includes an inner shell and an outer shell, the printed circuit board mounting legs unitarily extend from the outer shell and intimately abut against the corresponding at least one supporting leg in a transverse direction perpendicular to both said front-to-back direction and said vertical direction.

18. The electrical connector assembly as claimed in claim 13, wherein the front edge of the outer shell is located slightly in front of a front edge of the supporting member in the front-to-back direction.

19. The electrical connector assembly as claimed in claim 13, wherein said supporting member and said shell are discrete from each other.

* * * * *